United States Patent [19]

Latina

[11] Patent Number: 4,651,345

[45] Date of Patent: Mar. 24, 1987

[54] WRIST STRAP CONSTRUCTION FOR A BASEBALL GLOVE

[75] Inventor: Roland N. Latina, Belleville, Ill.

[73] Assignee: Figgie International Inc., Willoughby, Ohio

[21] Appl. No.: 868,063

[22] Filed: May 29, 1986

[51] Int. Cl.[4] ..... A41D 13/10

[52] U.S. Cl. ..... 2/19; 2/161 A

[58] Field of Search ..... 2/19, 161 A

[56] References Cited

U.S. PATENT DOCUMENTS

| | | | |
|---|---|---|---|
| 1,819,048 | 8/1931 | Till | 2/19 |
| 3,588,915 | 1/1970 | Latina | 2/19 |
| 3,590,389 | 7/1971 | Latina | 2/19 |
| 4,042,977 | 8/1977 | Antonious | 2/161 A |
| 4,546,495 | 10/1985 | Castillo | 2/161 A |

*Primary Examiner*—Louis K. Rimrodt

*Attorney, Agent, or Firm*—Senniger, Powers, Leavitt and Roedel

[57] ABSTRACT

An improved wrist strap construction for a baseball glove, comprising a wrist strap extending transversely with respect to the glove on the back wall of the glove generally adjacent the bottom of the glove, and an elastic web securing the inner end of the wrist strap to the glove at one side of an extension of the hand opening at the bottom of the glove extending up toward the finger stalls of the glove.

7 Claims, 4 Drawing Figures

WRIST STRAP CONSTRUCTION FOR A BASEBALL GLOVE

BACKGROUND OF THE INVENTION

This invention relates generally to a baseball glove, and more particularly to a glove with an improved wrist strap construction.

Reference may be made to U.S. Pat. Nos. 1,819,048, 3,528,107 and 3,590,389 showing baseball gloves with various wrist strap configurations.

SUMMARY OF THE INVENTION

Among the several objects of this invention may be noted the provision of a baseball glove (or mitt) having an improved wrist strap construction which is adapted for maintaining the glove snugly in place on the hand and wrist while at the same time enabling the hand readily to be flexed to close and otherwise manipulate the glove; the provision of such a glove which is durable; and the provision of such a glove which is pleasing in appearance.

Generally, the present invention is used in connection with a baseball glove of the type comprising front and back walls joined together to form thumb and finger stalls, the walls being free of connection at the bottom of the glove to form an opening for entry of the hand into the glove, an extension of the opening in the back wall of the glove extending from the bottom of the glove toward the stalls, and first and second back wall portions adjacent the bottom of the glove on opposite sides of the extension. The improvement of the present invention comprises a wrist strap extending transversely with respect to the glove on the back wall of the glove generally adjacent the bottom of the glove, elastic means securing one end of the wrist strap, constituting its inner end, to the first back wall portion, the elastic means being stretchable to permit limited movement of the wrist strap relative to the back wall of the glove, and means for guiding the wrist strap, when pulled against the resistance of said elastic means, to move generally transversely with respect to the back wall of the glove. The other free end of the wrist strap, constituting its outer end, is adapted to be pulled against the resistance of said elastic means to draw the first back wall portion closer to the second back wall portion to adjust the size of the hand opening according to the size of the hand. Means is also provided for releasably fastening the wrist strap in an adjusted position wherein the elastic means is adapted to maintain the wrist strap tensioned for providing a snug fit of the glove on the hand and also to permit yielding of the wrist strap when the glove is flexed so as not to unduly restrain movement of the hand. The elastic means is concealed from view when the wrist strap is fastened in its adjusted position.

Other objects and features will be in part apparent and in part pointed out hereinafter.

BRIEF DESCRIPTION OF THE DRAWINGS

Corresponding reference numerals indicate corresponding parts throughout the several views of the drawings.

DESCRIPTION OF THE PREFERRED EMBODIMENT

Figure 1:
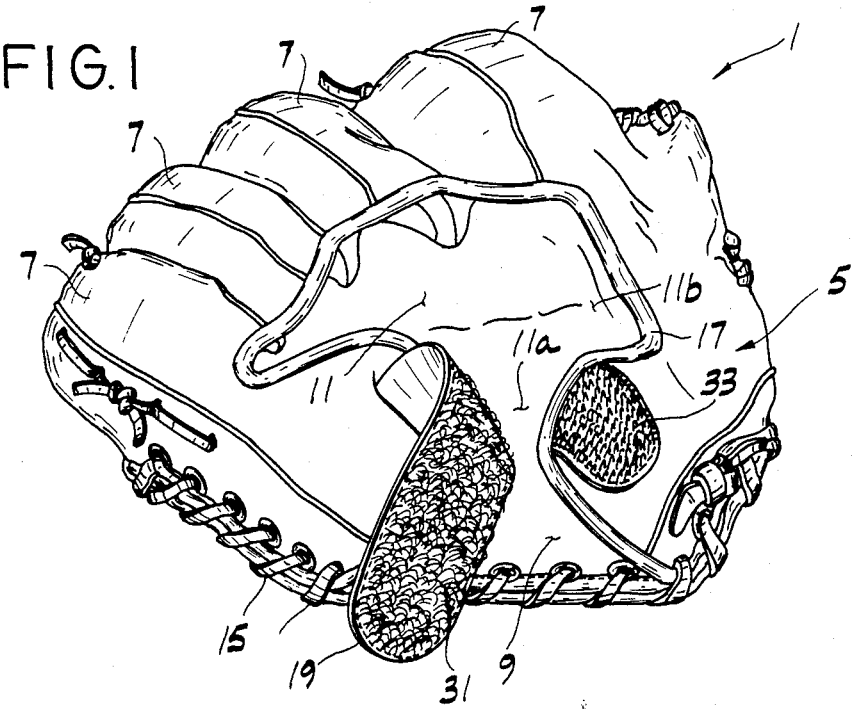
FIG. 1 is a perspective of the back of a glove having the wrist strap construction of the present invention, the wrist strap being shown unfastened and folded back for purposes of illustration.
Figure 2:
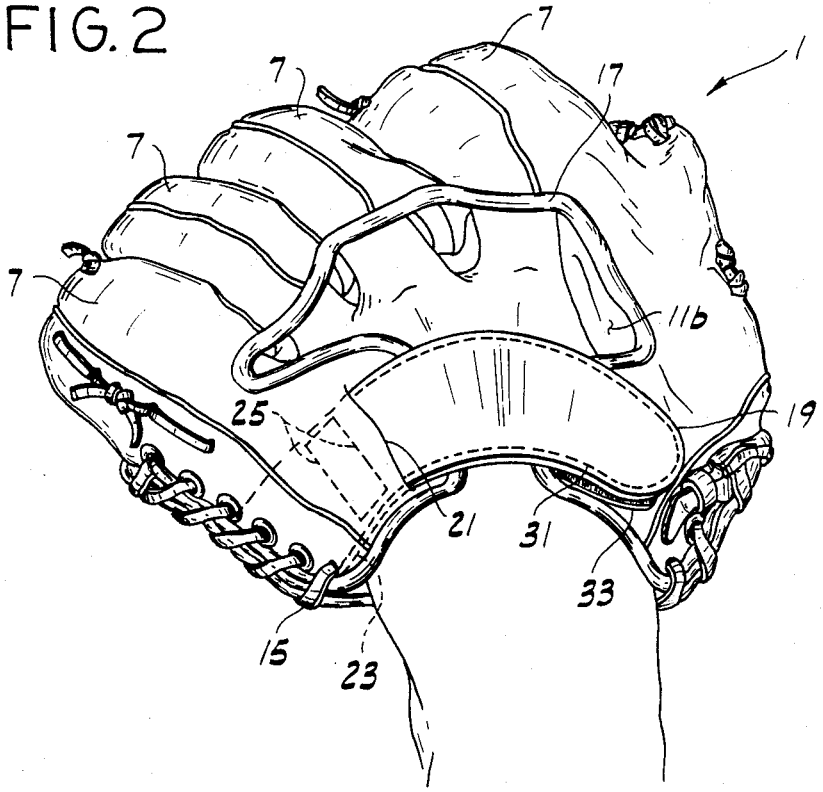
FIG. 2 is a view similar to FIG. 1 showing the wrist strap fastened.

Referring now to the drawings, a baseball glove having the wrist strap construction of the present invention is indicated in its entirety by the reference numeral 1. As is conventional, the glove comprises front and back walls, generally designated 3 and 5, respectively, joined together to form a thumb stall (not shown) and finger stalls 7. The glove illustrated is an infielder's glove having four finger stalls. It will be understood, however, that the present invention is applicable to other glove (and mitt) configurations. The front and back walls of the glove are free of connection at the bottom of the glove to form an opening 9 for entry of the hand into the glove, the opening thus being referred to as a hand opening. Indicated at 11 is an extension of the hand opening in the back wall 5 of the glove. This extension 11 extends from the hand opening 9 upwardly toward the finger stalls, having a relatively narrow lower section lla and a wider upper section llb exposing most of the back of the hand to view.

The front and back walls 3,5 of the glove each comprises an outer layer 12 of durable material, such as leather, and an inner liner 13 of relatively soft material. The outer layer and inner liner are connected at the sides of the glove and at the periphery of the hand opening 9 and its extension 11 by binding 15 and welting 17.

In accordance with this invention, an improved wrist strap 19 is provided at the back of the glove. The wrist strap comprises a length of relativley wide substantially non-stretchable material, such as leather, extending transversely with respect to the back wall 5 of the glove adjacent the bottom of the glove. As viewed in FIGS. 3 and 4, the left end of the strap, constituting its inner end, is disposed between the outer layer 12 and the inner liner 13 of the back wall and passes through a slot 21 onto the outside of the back wall of the glove. The wrist strap 19 is secured at its inner end to the glove by a web 23 of elastic material, the left end of the elastic web being caught in welting 17 at the left side of the glove (as viewed in FIGS. 3 and 4) and the right end of the web being stitched as indicated at 25 to the wrist strap adjacent the left end of the wrist strap. The elastic web permits limited movement of the wrist strap with respect to the glove when the strap is pulled. It will be noted in this regard that slot 21 extends generally lengthwise with respect to the glove and that it has a length not substantially greater than the width of the wrist strap 19. Thus, the slot constitutes means for guiding the wrist strap, when pulled against the resistance of the elastic web 23, to move generally transversely with respect to the back wall of the glove.

Figure 3:
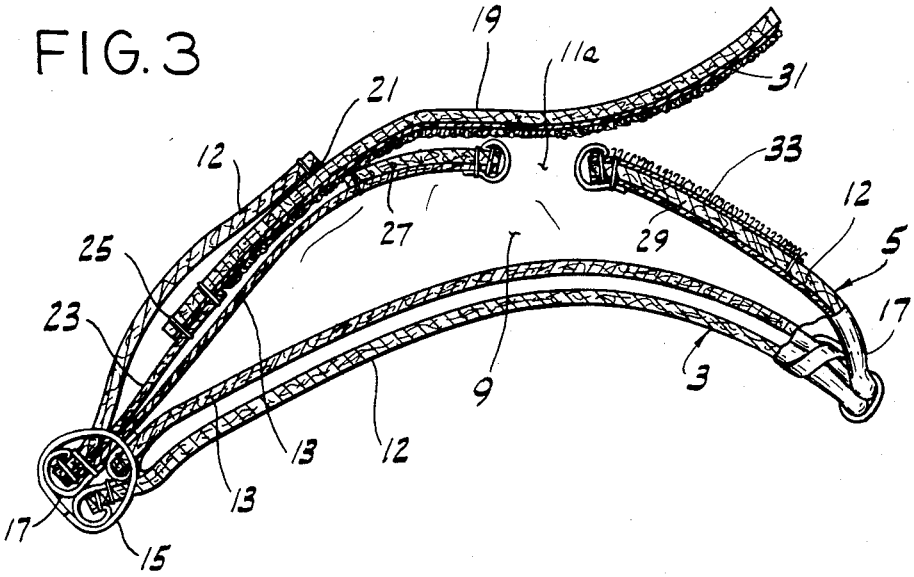
FIG. 3 is an enlarged transverse section through the wrist strap showing the wrist strap in an unfastened state.
Figure 4:
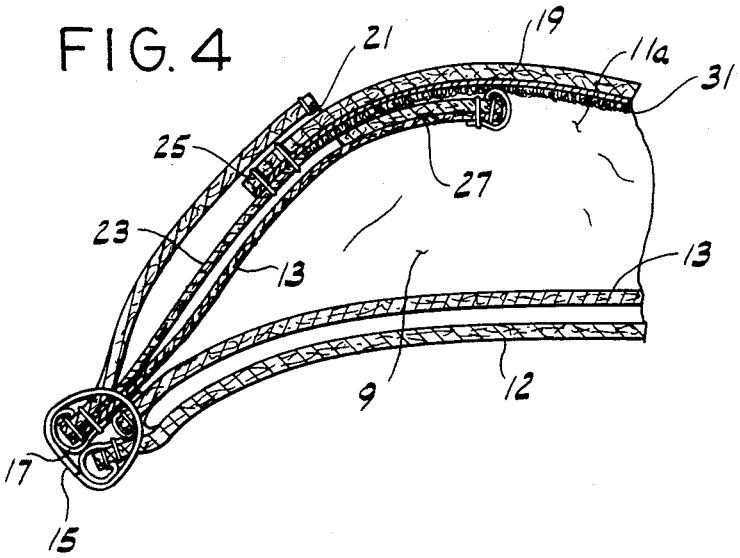
FIG. 4 is a view similar to FIG. 3 showing the wrist strap fastened.

When the wrist strap is pulled to the right as viewed in FIGS. 3 and 4, it serves to draw the back wall portions 27 and 29 of the glove on opposite sides of the extension 11 toward one another thereby to adjust the size of the hand opening 9 to fit the hand of the person wearing the glove. When in a suitably adjusted position, the wrist strap may be fastened in position by quick-release fastening means comprising a first fastening element 31 on the inside face of the wrist strap and a second fastening element 33 interengageable with the first fastening element on the outside face of back wall portion 29. As shown in FIGS. 3 and 4, these fastening elements may be hook and pile type fastening elements sometimes referred to as "Velcro" fastening elements. It will be understood, however, that other fastening means may be used without departing from the scope of this invention. It will be observed that the fastening element 31 extends from the outer (right as viewed in FIGS. 3 and 4) end of the wrist strap inwardly a considerable distance to ensure that a substantial length of this element engages the element 33 on the back wall of the glove regardless of the distance which the wrist strap may have to be pulled to adjust the hand opening 9 to fit the person wearing the glove.

It will be apparent from the foregoing that when the wrist strap 19 is pulled to its adjusted position and fastened in place, the elastic web 23 serves to maintain the wrist strap tensioned for providing a snug fit of the glove on the hand while at the same time permitting yielding of the wrist strap (i.e., limited movement of the wrist strap transversely with respect to the back of the glove) when the glove is flexed, as when it is closed, so as not to unduly restrain movement of the hand. The elastic web should be so sized and of sufficient strength to realize this objective. For example, the web may be a 2 inch-wide strap of a suitable blend of elastic material (e.g., a 33% polyester, 44% polypropylene and 23% rubber blend) stretchable 200–250% of its unstressed length and having an elastic recovery of at least 90%.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In a baseball glove comprising front and back walls joined together to form thumb and finger stalls, said walls being free of connection at the bottom of the glove to form an opening for entry of the hand into the glove, an extension of said opening in the back wall of the glove extending from the bottom of the glove toward said stalls, and back wall portions adjacent the bottom of the glove on opposite sides of said extension, the improvement comprising a wrist strap extending transversely with respect to the glove on the back wall of the glove generally adjacent the bottom of the glove, elastic means securing the wrist strap at one end, constituting its inner end, to the glove at one side of said extension, said elastic means being stretchable to permit limited movement of the wrist strap relative to the back wall of the glove, means for guiding the wrist strap, when pulled against the resistance of said elastic means, to move generally transversely with respect to the back wall of the glove, the other free end of the wrist strap, constituting its outer end, being adapted to be pulled against the resistance of said elastic means thereby to draw said back wall portions on opposite sides of said extension toward one another to adjust the size of said opening to fit the hand, and means for releasably fastening the wrist strap in an adjusted position wherein said elastic means is adapted to maintain the wrist strap tensioned for providing a snug fit of the glove on the hand and also to permit yielding of the wrist strap when the glove is flexed so as not to unduly restrain movement of the hand, said elastic means being concealed from view when the wrist strap is fastened in its adjusted position.

2. A baseball glove as set forth in claim 1 wherein said wrist strap is of a substantially non-stretchable material, such as leather.

3. A baseball glove as set forth in claim 1 wherein said first back wall portion comprises an outer layer of durable material and an inner liner, said elasic means and the inner end of the wrist strap being disposed between said outer layer and said inner liner and thereby concealed from view.

4. A baseball glove as set forth in claim 3 wherein said means for guiding the wrist strap comprises a slot in the outer layer of the first back wall portion extending generally lengthwise with respect to the glove and having a length not substantially greater than the width of the wrist strap, said wrist strap extending from between said outer layer and said inner liner, through the slot and thence onto the outside of the back wall of the glove.

5. A baseball glove as set forth in claim 4 wherein said elastic means comprises a web of elastic secured at one end to the inner end of the wrist strap and at its other end to the back wall of the glove.

6. A baseball glove as set forth in claim 4 wherein said elastic web is stitched to the wrist strap and to the back wall of the glove.

7. A baseball glove as set forth in claim 1 wherein said quick release fastening means comprises a first fastening element on the inner face of the wrist strap and a second fastening element interengageable with said first fastening element on the outer face of the second back wall portion.

* * * * *